United States Patent [19]

Yunan

[11] 4,248,152

[45] Feb. 3, 1981

[54] FIELD-CONNECTED EXPLOSIVE BOOSTER FOR PROPAGATING A DETONATION IN CONNECTED DETONATING CORD ASSEMBLIES CONTAINING LOW-ENERGY DETONATING CORD

[75] Inventor: Malak E. Yunan, Boonton Township, Morris County, N.J.

[73] Assignee: E. I. Du Pont de Nemours & Company, Wilmington, Del.

[21] Appl. No.: 6,013

[22] Filed: Jan. 24, 1979

[51] Int. Cl.[3] ..... C06C 5/00

[52] U.S. Cl. ..... 102/27 F; 102/27 R

[58] Field of Search ..... 102/27 R, 27 F, 29, 102/30

[56] References Cited

U.S. PATENT DOCUMENTS

| | | | |
|---|---|---|---|
| 3,205,818 | 9/1965 | Coulson | 102/27 R |
| 3,374,736 | 3/1968 | Dow | 102/27 R |

FOREIGN PATENT DOCUMENTS

| | | | |
|---|---|---|---|
| 863290 | 10/1977 | Belgium | 102/27 R |

*Primary Examiner*—Donald P. Walsh

*Attorney, Agent, or Firm*—Diamond C. Ascani

[57] ABSTRACT

An explosive booster capable of being connected to donor and receiver detonating cords in the field via a cord-connector to propagate a detonation from the donor cord to the receiver cord, at least one of which cords is a low-energy detonating cord, has a granular explosive charge, e.g., PETN, between the walls and closed bottoms of inner and outer shells, the inner shell having an axial open cavity and the explosive charge being sealed off from the atmosphere. A length of detonating cord is inserted into the cavity of the booster in a manner such that an end-portion thereof is surrounded by the granular explosive in the spacing between the walls of the shells, the cord being held in the cavity by retention means located preferably in the cavity. Another length of detonating cord is positioned transversely outside and adjacent to the closed end of the outer shell, preferably in a transverse slot in a tube which holds the booster.

Initiation of the receiver cord by the booster explosive (the latter initiated by the donor cord) occurs even if the cord in the cavity fails to abut the bottom of the cavity.

30 Claims, 3 Drawing Figures

FIELD-CONNECTED EXPLOSIVE BOOSTER FOR PROPAGATING A DETONATION IN CONNECTED DETONATING CORD ASSEMBLIES CONTAINING LOW-ENERGY DETONATING CORD

BACKGROUND OF THE INVENTION

1. Field of the Invention

The present invention relates to an explosive device for transmitting an explosion from a donor detonating cord to a receiver, usually low-energy, detonating cord, and to an assembly containing said explosive device for the connection of said cords and initiation of the receiver cord.

2. Description of the Prior Art

The hazards associated with the use of electrical initiation systems for detonating explosive charges in mining operations, i.e., the hazards of premature initiation by stray or extraneous electricity from such sources as lightning, static, galvanic action, stray currents, radio transmitters, and transmission lines, are well-recognized. For this reason, non-electric initiation through the use of a suitable detonating fuse or cord has been looked upon as a widely respected alternative. A typical high-energy detonating cord has a uniform detonation velocity of about 6000 meters per second and comprises a core of 6 to 10 grams per meter of pentaerythritol tetranitrate (PETN) covered with various combinations of materials, such as textiles, waterproofing materials, plastics, etc. However, the magnitude of the noise produced when a cord having such PETN core loadings is detonated on the surface of the earth, as in trunklines, often is unacceptable in blasting operations in developed areas. Also, the brisance (shattering power) of such a cord may be sufficiently high that the detonation impulse can be transmitted laterally to an adjacent section of the cord or to a mass of explosive which, for example, the cord contacts along its length. In the latter situation, the cord cannot be used to initiate an explosive charge in a borehole at the bottom (the "bottom-hole priming" technique), as is sometimes desired.

Low-energy detonating cord (LEDC) was developed to overcome the problems of noise and high brisance associated with the above-described 6–10 grams per meter cord. LEDC has an explosive core loading of only about 0.02 to 2 grams per linear meter of cord length, and often only about 0.4 gram per meter. This cord is characterized by low brisance and the production of little noise, and therefore can be used as a trunkline in cases where noise has to be kept to a minimum, and as a downline for the bottom hole priming of an explosive charge.

Until recently, most LEDC described in the art had a continuous core of a granular cap-sensitive high explosive such as PETN heavily confined in a metal sheath or one or more woven textile sheaths. An improved LEDC which is light-weight, flexible, strong, and non-conductive, detonates at high velocity, and is readily adapted to high-speed continuous manufacturing techniques is described in Belgian Pat. No. 863,290, granted July 25, 1978, the disclosure of which is incorporated herein by reference. This improved cord has a continuous solid core of a deformable bonded detonating explosive composition comprising a crystalline high explosive compound admixed with a binding agent, and a protective plastic sheath enclosing the core, no metal or woven textile layers being present around the core or sheath. Preferably, one or more continuous strands of reinforcing yarn, e.g., running substantially parallel to the core's longitudinal axis, are present outside the core. The loading of crystalline high explosive in the bonded explosive core is about from 0.1 to 2 grams per meter of length. This cord can be initiated reliably by means of a coaxially abutted blasting cap, but not by the detonation of another length of detonating cord with which it is spliced or knotted.

In the past, explosive booster charges have been employed to transmit a detonation impulse from a main line of LEDC to a branch line of detonating fuse. U.S. Pat. No. 3,205,818, for example, shows a booster charge of a high-velocity detonating explosive contained in a capsule which is crimped to one end of a length of LEDC which abuts the booster charge. The bottom, closed end of the capsule is positioned adjacent to the side of a length of detonating fuse. The booster charge is used when the detonation impulse is to be transmitted from the LEDC to the detonating fuse. This booster-connector has to be pre-assembled with the LEDC at the place of manufacture to seal the capsule, thereby protecting the booster charge until the time of use. As a result, the booster-connector can be used only with a fixed length of LEDC. Furthermore, the booster charge described in U.S. Pat. No. 3,205,818 is stated therein to be useful with a type of LEDC that requires the booster to transmit a detonation impulse from itself to detonating fuse, but not in the reverse direction.

A booster which does not depend on its pre-assembly with a detonating cord for sealing, but rather is a self-contained, sealed unit adapted to receive and hold a detonating cord in position, the booster and cord being assembled usually at the time of use, would offer such advantages as safety and convenience because of the separated conditions of the components of the assembly during handling and storage, possible separate classification of the components for transportation, etc. In addition, a booster which would function reliably with less-sensitive low-energy detonating cords, i.e., those of the type which require a booster to be initiated by, as well as to initiate, detonating fuse, would offer the advantage of being applicable to more types of cords, including the type described in the aforementioned Belgian patent.

SUMMARY OF THE INVENTION

The present invention provides an improved explosive booster for initiating a detonating cord in assemblies containing low-energy detonating cord, which booster comprises first and second shells, preferably made of metal, each closed at one end and open at the opposite end, the second shell being seated closed-end-innermost and coaxially within the first shell in a manner such as to produce a spacing between the closed ends of the shells and between their facing side walls, a granular high-velosity detonating explosive, e.g., pentaerythritol tetranitrate (PETN), being present in the spacing between the side walls and closed ends of the shells, the explosive-containing spacing between the shells being sealed off from the atmosphere, and an open cavity extending from one end to the other of the second shell for receiving a detonating cord, the granular explosive being adapted to propagate a detonation from a donor detonating cord transversely positioned outside and adjacent to the closed end of the first shell to a receiver detonating cord positioned in the cavity in the second shell, or conversely, from a donor detonating cord positioned in the cavity in the second shell to a receiver detonating cord transversely positioned outside and adjacent to the closed end of the first shell, when at least one of the donor and receiver cords, usually at least the receiver cord, is a low-energy detonating cord, e.g., of the type described in Belgian Pat. No. 863,290, and an end-portion of the cord in the cavity, preferably at least about a 3.0 mm portion, is surrounded by the granular explosive in the spacing between the side walls of the shells.

A preferred booster contains a cord-retention means in the cavity in the second shell for holding the detonating cord coaxially therein, e.g., one or more inwardly directed teeth or prongs formed on the inside wall of the second shell, or preferably, on the inner end of an open-ended metal sleeve that frictionally engages the inside wall of the second shell.

The booster is a self-contained, sealed unit adapted to be packaged, stored, and transported apart from the cords with which it is designed to be used. At the place of use it can be incorporated into a detonating cord assembly containing, in addition to the booster, a detonating cord trunkline having a side-portion outside and adjacent to the booster; a detonating cord downline having an end-portion contained in the booster in the cavity of the second shell; means, preferably in the booster, for retaining the downline coaxially in the cavity in a manner such that the granular explosive in the booster surrounds an end-portion of the downline; and means for retaining the trunkline adjacent to the closed end of the first shell transverse to the shell's axis.

A preferred method of forming the cord/booster assembly of the invention is to employ as a cord-connector a tube of preferably electrically nonconductive material having two open ends and a transverse slot communicating with the bore of the tube, the trunkline being engaged in the slot in a recessed position in the tube substantially perpendicular to the tube's longitudinal axis, and the booster being snugly seated in the tube's bore with the closed end of the first shell of the booster adjacent to the side-portion of the trunkline engaged in the slot. The slotted cord-connector tube has stop means, e.g., an annular projection in its bore, adjacent to one end and suitably spaced from the slot so as to permit the booster to be properly positioned therein with the closed end of the booster's first shell taking up its position adjacent to the slot. When the downline is in place in the booster, movement of the booster in the direction of the downline is prevented by the stop means.

The term "low-energy detonating cord" (LEDC) as used herein is meant to denote any detonating cord that has an explosive core loading of about from 0.02 to 2 grams per meter, and that does not reliably initiate, or is not initiated by, another detonating cord with which it is spliced or knotted. In the booster-cord assembly of the invention, the donor or receiver cord is LEDC, and the other can be LEDC as well, or a detonating cord of higher explosive core loading or degree of sensitivity. For most applications, the receiver cord will be LEDC.

BRIEF DESCRIPTION OF THE DRAWING

In the accompanying drawing, which illustrates specific embodiments of the explosive booster, booster-containing cord connector, and detonating cord assembly of the invention.

DETAILED DESCRIPTION

Figure 1:
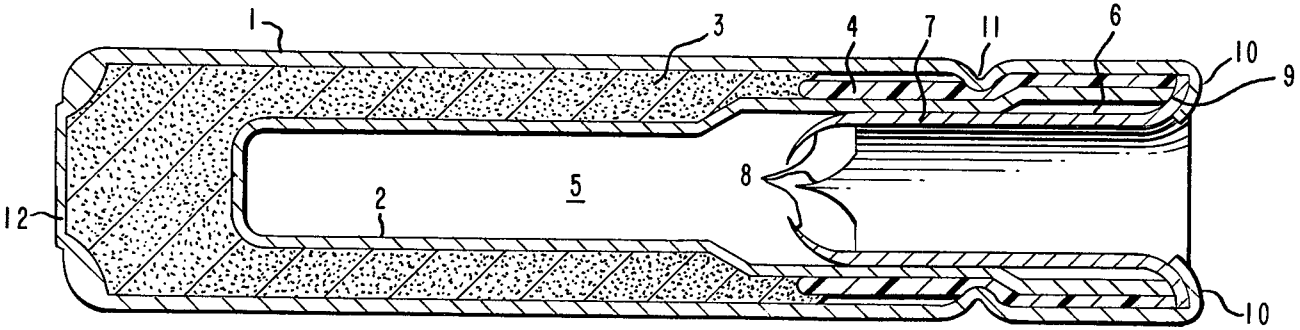
FIG. 1 is a longitudinal cross-section of an explosive booster of the invention.

In the explosive booster depicted in FIG. 1, 1 is a first metal shell, i.e., the outer shell of the booster; and 2 is a second metal shell positioned coaxially within shell 1. Both shell 1 and shell 2 are closed at one end and open at the opposite end, shell 2 being seated within shell 1 with its closed end the innermost end in a manner such as to produce a spacing between the closed ends of shells 1 and 2 and between their facing side walls, a granular high-velocity detonating explosive 3 being packed in this spacing.

A deformable grommet or sleeve 4, e.g., one made of rubber or a plastic such as polyethylene, fits around shell 2 near the outer, open end thereof. A convenient way of making the booster is to load explosive 3 into shell 1, and then to seat shell 2, with grommet 4 mounted thereon, within shell 1 while displacing some of explosive 3 up into the spacing between the shells' walls. Grommet 4 is of such a length as to extend into the space between the walls about as far as the boundary of explosive 3.

One of the functions of inner shell 2 is to provide a means of sealing explosive 3 from the atmosphere, a feature which is essential if the booster is to have a field-assembly capability. Another function of shell 2 is associated with the open cavity 5 therein that extends from one end of shell 2 to the other. This cavity acts as a well for the proper axial positioning of the downline cord. Located in cavity 5 is cord-retention means 6 for retaining the downline cord in position in the well. Cord-retention means 6 is an open-ended metal sleeve 7 that frictionally engages the inside wall of shell 2 and has a cord-gripping means 8, i.e., a number of inwardly directed prongs, formed on its inner end. While the cord can be inserted into cavity 5 through prong-ended sleeve 7, the prongs prevent the motion of the cord in the opposite direction when tension is applied thereto. Sleeve 7 is of such a length as to extend into cavity 5 at least about as far as the boundary of explosive 3. In this manner, even if the downline cord were to be inserted into cavity 5 only to the extent that it were gripped by prongs 8 near the end of the cord without further pushing of the cord into the cavity, an end-portion of the cord, e.g., at least about a 3.0 mm portion, would be surrounded by explosive 3. The outer end of metal sleeve 7 is provided with a lip portion 9 that extends over the outer ends of shell 2 and grommet 4, and the outer end of shell 1 is folded back over lip portion 9 with roll-over crimp 10, which retains sleeve 7 in position, and provides a conductive path or a Faraday shield for protection against extraneous electricity. Circumferential crimp 11 in the side of shell 1 seals explosive 3 from the atmosphere.

Explosive 3 is one which is sensitive to initiation by a shock pulse produced by the detonation of a detonating cord trunkline transversely positioned outside and adjacent to the closed end 12 of shell 1. End 12 is coin-bottomed, a feature which can be useful if the sensitivity of explosive 3 and/or the explosive loading of the trunkline core are marginal. The variation in the diameter of inner shell 2 is not critical but is a convenience to adapt to the different diameters of shell 1, sleeve 7, and the downline cord to be positioned in cavity 5.

The booster is a self-contained, sealed unit and can be stored, transported, and otherwise handled as required separated from the detonating cords with which it is designed to be used. At the time of use, the booster can be assembled together with the trunkline and downline cords using any suitable connection means. However, a preferred means for retaining the cords and booster in their required positions for effecting the propagation of a detonation from a trunkline to a downline or vice versa, is a connector of the type described in U.S. Pat. No. 3,205,818, the disclosure of which is incorporated herein by reference.

Figure 2:
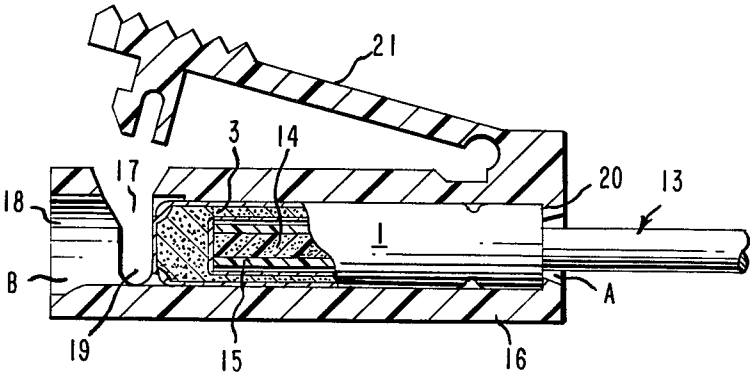
FIG. 2 is a view in partial cross-section of an explosive booster of the invention in position in a cord-connector adapted to retain a trunkline cord adjacent to the booster.

Referring to the booster shown in FIG. 1 and the booster-connector assembly shown in FIG. 2, an end-portion of a length of low-energy detonating cord downline 13 is located in cavity 5 and has its end seated against the closed end of shell 2. Prongs 8 grip cord 13 and thus prevent it from being pulled out of cavity 5. Cord 13 consists of a continuous solid core 14 of a deformable bonded detonating explosive composition, e.g., superfine PETN admixed with a binding agent such as plasticized nitrocellulose; core-reinforcement means (not shown) consisting of a mass of filaments derived from multi-filament yarns in contact with the periphery of core 14 parallel to the core's longitudinal axis; and a protective plastic sheath 15, which encloses core 14 and the core-reinforcing filaments. Cords of this type are described in the aforementioned Belgian Pat. No. 863,290. The explosive loading in the core of this downline cord preferably is about from 0.4 to 2 grams per meter of length.

The connector shown in FIG. 2 comprises a tube 16 preferably of electrically nonconductive material, e.g., a plastic material, having open extremities A and B and a transverse slot 17 near extremity B and communicating with the bore 18 of the tube. Slot 17 has a recessed channel 19 which is adapted to engage a trunkline perpendicular to the longitudinal axis of tube 16. The booster is seated in the bore 18 of the tube with the closed end of shell 1 adjacent to slot 17 and the other end of shell 1 resting against shoulder projection 20, which prevents the booster from being pulled out of tube 16 when a force is exerted on downline cord 13. It is feasible to first insert the booster into tube 16 through extremity B until it becomes seated against projection 20 (e.g., at the time of use, or at the place of manufacture or elsewhere prior to the time of use), and thereafter to insert cord 13 into cavity 5 until the end of cord 13 becomes seated against the closed end of shell 2. Likewise, cord 13 can be positioned in cavity 5 first, and thereafter the booster-downline assembly threaded through tube 16 from extremity B until the booster becomes seated against projection 20 while downline cord 13 emerges from extremity A. Tube 16 has slotted locking means 21 adapted to form a closure with slot 17 to lock the trunkline in place.

Figure 3:
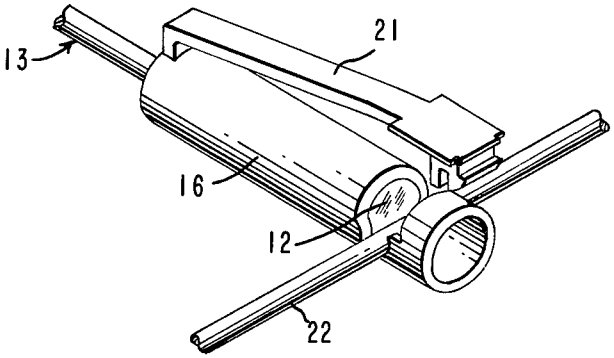
FIG. 3 is a perspective view of the booster-connector assembly shown in FIG. 2 with a length of trunkline cord in position in the connector.

FIG. 3 shows a length of low-energy detonating cord trunkline 22, e.g., a cord having the same structure as the downline and a core explosive loading in the same range, positioned in recessed channel 19 in a manner such that a side-portion of the trunkline is adjacent to the closed end 12 of shell 1.

The use of the booster and cord assembly of the invention will now be described by way of an example.

EXAMPLE 1

The booster, cords, and connector are those shown in the drawing. Shell 1 is made of 5052 aluminum, and has a wall thickness of 0.2 mm and an internal diameter of b 6.6 mm. Its overall length is 33 mm, and the thickness of the coined bottom 12 is 0.1 mm. Shell 2 is also made of 5052 aluminum, and has a wall and bottom thickness of 0.3 mm. The length of shell 2 is 13.2 mm in its smallest-internal-diameter section of 2.9 mm, and 5.1 mm in its largest-internal-diameter section of 5.1 mm. Its overall length is 26.4 mm. The upper taper in the wall of shell 2 is 15° off the longitudinal axis, and the lower taper 30° off the longitudinal axis.

Explosive 3 is PETN, 0.1 gram of superfine PETN (of the type prepared by the method described in U.S. Pat. No. 3,754,061) at the bottom of shell 1 to a depth of 5 mm, and the remainder 0.5 gram of cap-grade PETN, slightly compacted as shell 2 is seated in shell 1. The total height of explosive 3 is 20 mm.

Grommet 4 is made of 0.5-mm-thick polyethylene, and sleeve 7 is made of 0.3-mm-thick bronze.

Downline cord 13 has an outer diameter of 2.5 mm, an 0.8-mm-diameter core (14), and a 0.9-mm-thick low-density polyethylene sheath (15). The core 14 consists of a mixture of 75% superfine PETN, 21% acetyl tributyl citrate, and 4% nitrocellulose prepared by the procedure described in U.S. Pat. No. 2,992,087. The superfine PETN is of the same type as that used in the bottom of shell 1, its average particle size being less than 15 microns, with all particles smaller than 44 microns. The core-reinforcing filaments are derived from eight 1000-denier strands of polyethylene terephthalate yarn substantially uniformly distributed on the periphery of core 14. The PETN loading in core 14 is 0.53 gram per meter.

One end of a 5-meter length of downline cord 13 is inserted into cavity 5 of shell 2 of the booster until it becomes seated against the closed end of shell 2. Prongs 8 grip downline cord 13 and prevent it from being retracted from shell 2. The booster has previously been positioned in tube 16 until it has become seated against projection 20 as shown in FIG. 2. Tube 16 is made of low-density polyethylene.

Trunkline cord 22 (FIG. 3) is the same as downline cord 13 except that the core diameter in the trunkline cord is 1.3 mm, and the PETN loading in the core is 1.49 grams per meter. A length of trunkline cord 22 is positioned in recessed channel 19 of slot 17 of connector tube 16 whereby the closed end 12 of shell 1 of the booster is butted against the side of trunkline cord 22. Slotted locking means 21 is pushed into slot 17 and snaps into place, thereby locking trunkline cord 22 in its transverse position.

The free end of downline cord 13 is butted with its side against the percussion-sensitive element of a percussion-type delay cap. Trunkline 22 is detonated by means of a No. 6 blasting cap having its end in coaxial abutment with the exposed end of the cord. The detonation is transmitted from the trunkline to the booster, from the booster to the downline, and from the downline to the percussion-type delay cap. No failures are encountered with the assembly in 600 attempts.

The above example describes the use of the explosive booster of this invention to transmit a detonation impulse from an LEDC trunkline 22 (donor) to a similar LEDC downline 13 (receiver). However, the booster also can be used to transmit the detonation impulse from downline 13 (donor) to trunkline 22 (receiver). Furthermore, when downline 13 is LEDC, trunkline 22 can be a detonating cord or higher explosive core loading or degree of sensitivity than the downline cord; and, conversely, when trunkline 22 is LEDC, downline 13 can be of higher core loading or sensitivity. In such cases, too, the detonation can progress from the trunkline to the downline, or vice versa. For most uses, the receiver cord will be LEDC, usually downline 13.

Although practically speaking it is most convenient to insert downline cord 13 into the cavity of the inner shell of the booster until the end of the cord contacts the bottom of the inner shell, and such positioning of the cord will satisfy the condition that an end-portion thereof be surrounded by booster explosive 3, the booster functions properly even when the cord does not rest against the bottom of the shell. It has been found that a spacing between the end of the cord in the cavity and the bottom of shell 2 does not deleteriously affect the ability of a detonation to be propagated from the donor to the receiver cord when an end-portion of the cord, preferably at least about a 3.0 mm portion, is surrounded by booster explosive 3. Furthermore, when this condition is satisfied, the presence of foreign matter such as water or sand in the space between the end of the cord and the bottom of the inner shell does not interfere with the transmission of the detonation from the donor to the receiver cord via the booster explosive. These features are of great importance in a field-assembled booster where foreign matter could enter cavity 5 before cord 13 is inserted, and where a cord may not always be pushed to the bottom of the shell by the assembler.

The critical effect of the position of cord 13 relative to the location of booster charge 3 in the wall spacing between shells 1 and 2 is shown in the following examples.

EXAMPLE 2

Shell 1 has an inner diameter of 4.4 mm, and shell 2 a uniform outer diameter of 3.2 mm. Explosive charge 3 consists of a bottom load of 0.03 gram of the superfine PETN described in Example 1 (3.2 mm thick), topped with a 0.10-gram piece of the deformable bonded detonating explosive composition that forms core 14 of cord 13, described in Example 1. When inner shell 2 is pressed into place, the bonded explosive composition deforms around the outside walls thereof to form a cup 6.4 mm high.

When this booster is assembled with the donor and receiver cords as described in Example 1, 300 boosters out of 300 tested initiate downline receiver cord 13 when the latter is seated against the bottom of shell 2, i.e., when an end-portion of cord 13 6.4 mm high is surrounded by explosive 3. When cord 13 is retracted so that a 3.2 mm end-portion of cord 13 is surrounded by explosive 3, and a 3.2 mm gap exists between the end of cord 13 and the bottom of shell 2, the detonation is transmitted to (initiates) the downline in 100 out of 100 tests.

CONTROL EXPERIMENT

However, when cord 13 is retracted so that none of the cord is surrounded by explosive, the booster loses reliability as shown in the following:

| Gap (mm) | No. of Tries | No. of Propagations |
|---|---|---|
| 6.4 | 50 | 50 |
| 9.5 | 10 | 7 |
| 12.7 | 10 | 5 |

EXAMPLE 3

Example 2 is repeated with the exception that explosive charge 3 is 0.16 gram of superfine PETN, and the height of explosive 3 in the wall spacing, starting from the bottom of shell 2, is 4.0 mm. When cord 13 is seated against the bottom of shell 2, the detonation is propagated to the downline in each of 25 attempts. The same results are obtained when the cord is retracted so that only an 0.8 mm portion is surrounded by the explosive (3.2 mm gap). However, only 23 propagations are achieved out of 25 tries when the gap is 4.0 mm (explosive surrounds none of the cord), and 21 out of 25 when the gap is 4.8 mm.

EXAMPLE 4

Example 2 is repeated except that the inner diameter of shell 1 is 6.4 mm., and explosive charge 3 is 0.32 gram of superfine PETN. The height of charge 3 from the bottom of shell 2 is 9.5 mm. When cord 3 is seated against the bottom of shell 2, the detonation is propagated to the downline in each of 10 attempts. The same results are obtained when the cord is retracted so that a 6.4 mm portion is surrounded by the explosive (3.2 mm gap). When the gap is 6.4 mm, 25 propagations are obtained out of 25 tries. When the gap is 9.5 mm, 40 propagations are obtained out of 40 tries, and 13 out of 15 when the gap is 12.7 mm.

When the 3.2 mm gap is filled with grit, 10 propagations are obtained out of 10 tries. On the other hand, when the 9.5 mm gap contains grit (filled with dry or wet grit, or 6.4 mm of grit and 3.2 mm air), 32 propagations are obtained out of 35 tries. When the 12.7 mm gap is filled with wet grit, 2 propagations out of 10 tries are obtained.

While the invention has been described primarily with reference to a specific type of low-energy detonating cord and booster explosive charge, it will be understood that other cords and booster charges known to the art may be substituted for those detailed herein. Variations in the form of the cord-retention means and deformable grommet also are possible. For example, inner shell 2 and deformable grommet 4 can be incorporated into a single plastic part, e.g., of an elastomeric or thermoplastic material. With respect to the cord-retention means, this can be provided outside the booster per se, e.g., on the cord-connector, in the form of one or more teeth or prongs, for example; or on the outside wall of shell 1. However, cord-retention means within the cavity of shell 2 is preferred as it is more readily adapted to serve also as an indicator that the end of the cord will be surrounded by explosive 3. For example, if one or more teeth or prongs are present in the cavity, either integral with the inside wall of shell 2, or as part of a separate cord-retention component as shown in FIG. 1, they can be positioned at a location relative to explosive 3 such that an end-portion of cord 13 will be surrounded by the explosive as long as the cord is gripped, regardless of whether or not the cord is shoved farther into the cavity. Thus, tube 7 is sufficiently long that prongs 8 reach the explosive boundary, preferably so that, when cord 13 is gripped thereby, at least about 3.0 mm of the cord is surrounded by explosive. The length of the explosive charge in the wall spacing depends on the length of shell 2 and on the conditions used to assemble the booster.

Shells 1 and 2 and components 16 and 21 of the cord connector, can be made of metal or plastic, metal being preferred for the outer shell of the booster, and plastic for the connector.

One of the factors that will govern the selection of the booster explosive is the energy output of the donor detonating cord, a more sensitive explosive being required with a donor cord of lower core loading, which results in a lower output. For example, if the explosive core loading of the donor cord is at least about 2 grams per meter, booster explosive charge 3 can be totally cap-grade PETN. At core loadings of at least about 1 gram, and up to about 2 grams, per meter, the booster explosive should be more sensitive at least in a zone nearest the donor cord, e.g., a layer of superfine PETN at the bottom of shell 1 when the trunkline is the donor cord, or in the spacing between the walls of shells 1 and 2 when the downline is the donor cord. At donor core loadings below 1 gram per meter, a more sensitive explosive such as lead azide should be used in the zone nearest the donor cord.

I claim:

1. An explosive booster adapted to be fixedly connected to donor and receiver detonating cords in the field and comprising first and second shells each closed at one end and open at the opposite end, said second shell being seated closed-end-innermost and coaxially within said first shell in a manner such as to produce a spacing between the closed ends of said shells and between their facing side walls, a granular high-velocity detonating explosive being present in the spacing between the side walls and closed ends of said shells, the explosive-containing spacing between said shells being sealed off from the atmosphere, and an open cavity extending from one end to the other of said second shell for receiving a detonating cord, said granular explosive being adapted to propagate a detonation from a donor detonating cord transversely positioned outside and adjacent to the closed end of said first shell to a receiver detonating cord positioned in the cavity in said second shell, or, conversely, from a donor detonating cord positioned in the cavity in said second shell to a receiver detonating cord transversely positioned outside and adjacent to the closed end of said first shell, when at least one of said donor and receiver cords is a low-energy detonating cord and an end-portion of the cord in said cavity is surrounded by said granular explosive in the spacing between the side walls of said shells.

2. The explosive booster of claim 1 having a cord-retention means for holding a detonating cord coaxially in said cavity.

3. The explosive booster of claim 2 wherein said cord-retention means is located in said cavity.

4. The explosive booster of claim 3 wherein said cord-retention means is an open-ended sleeve having cord-gripping means associated therewith, said sleeve frictionally engaging the inside wall of said second shell and extending from the open end of said second shell toward the center of said cavity.

5. The explosive booster of claim 4 wherein the granular explosive in the spacing between the side walls of said shells terminates in the general region of said second shell where the inner end of said sleeve is located.

6. The explosive booster of claim 4 and 5 wherein said cord-gripping means consists of one or more inwardly directed prongs formed on the inner end of said sleeve.

7. The explosive booster of claim 1 or 2 wherein said first and second shells are made of metal, and a deformable grommet is sandwiched between said shells starting from their open ends and extending approximately to the boundary of the granular explosive in the spacing between the side walls of said shells, said shells and grommet being held together by a circumferential side crimp.

8. The explosive booster of claim 4 wherein said sleeve is made of metal and, at its outer end, is provided with a lip portion that extends over the end of said second shell.

9. The explosive booster of claim 1, 2, 6 or 7 wherein said granular explosive is selected from the group consisting of pentaerythritol tetranitrate, cyclotrimethylenetrinitramine, and cyclotetramethylenetetranitramine.

10. A booster-connector assembly comprising the explosive booster of claim 1 snugly seated in the bore of a tube having two open ends and a transverse slot communicating with said bore, said booster being positioned with the closed end of the first shell thereof adjacent to said slot, said slot being adapted to engage a detonating cord trunkline in a recessed position in said tube substantially perpendicular to the tube's longitudinal axis, said tube having locking means adjacent said transverse slot for preventing the disengagement of said trunkline therefrom and stop means adjacent one end to prevent the booster from being pulled out of said tube when a force is exerted on a detonating cord downline positioned in the booster.

11. A detonating cord assembly comprising:

(a) a detonating cord trunkline;

(b) a detonating cord downline;

(c) an explosive booster adjacent to a side-portion of said trunkline and containing a section of said downline, said booster comprising first and second shells each closed at one end and open at the opposite end, said second shell being seated closed-end-innermost and coaxially within said first shell in a manner such as to produce a spacing between the closed ends of said shells and between their facing side walls, a granular high-velocity detonating explosive being present in the spacing between the side walls and closed ends of said shells, the explosive-containing spacing between said shells being sealed off from the atmosphere, and a cavity extending from one end to the other of said second shell and containing said section of detonating cord downline, said downline and/or trunkline being low-energy detonating cords;

(d) means for retaining said downline coaxially in the cavity of said second shell in a manner such that said granular explosive surrounds an end-portion of said downline; and (e) means for retaining said trunkline adjacent to the closed end of said first shell transverse to the axis of said shell.

12. The detonating cord assembly of claim 11 wherein said granular explosive surrounds at least 3 mm of said downline.

13. The detonating cord assembly of claim 12 wherein the end of said downline is seated against the closed end of said second shell.

14. The detonating cord assembly of claim 11 wherein said means for retaining said downline in the cavity of said second shell is an open-ended sleeve having cord-gripping means associated therewith, said sleeve frictionally engaging the inside wall of said second shell and extending from the open end of said second shell toward the center of said cavity.

15. The detonating cord assembly of claim 14 wherein said granular explosive in the spacing between the side walls of the shells terminates in the general region of said second shell where the inner end of said sleeve is located.

16. The detonating cord assembly of claim 14 wherein said cord-gripping means consists of one or more inwardly directed prongs formed on the inner end of said sleeve.

17. The detonating cord assembly of claim 11, 12 or 14 wherein said first and second shells are made of metal, and a deformable grommet is sandwiched between said shells starting from their open ends and extending approximately to the boundary of the granular explosive in the spacing between the side walls of said shells, said shells and grommet being held together by a circumferential side crimp.

18. The detonating cord assembly of claim 11 wherein said trunkline and downline cords comprise a continuous solid core of a deformable bonded detonating explosive composition comprising a crystalline high explosive compound admixed with a binding agent, and a protective plastic sheath enclosing the core.

19. The detonating cord assembly of claim 11 wherein said means for retaining said trunkline adjacent to the closed end of said first shell transverse to the axis of said shell comprises a tube having two open ends and a transverse slot communicating with the bore of the tube, said trunkline being engaged in said slot in a recessed position in said tube substantially perpendicular to the tube's longitudinal axis, and said booster being snugly seated in said tube's bore with the closed end of said first shell of said booster adjacent to the side-portion of said trunkline engaged in said slot.

20. The detonating cord assembly of claim 19 wherein said tube has locking means adjacent said transverse slot for preventing the disengagement of said trunkline therefrom, and stop means adjacent one end of said tube to prevent said booster from being pulled out of said tube when a force is exerted on said downline.

21. The detonating cord assembly of claim 11 wherein said trunkline is a donor detonating cord, and said downline is a receiver low-energy detonating cord.

22. The detonating cord assembly of claim 21 wherein said trunkline is a low-energy detonating cord.

23. The detonating cord assembly of claim 11 wherein said granular explosive is selected from the group consisting of pentaerythritol tetranitrate, cyclotrimethylenetrinitramine, and cyclotetramethylenetetranitramine.

24. The detonating cord assembly of claim 23 wherein said trunkline or said downline is a donor detonating cord having a core explosive loading of about from 1 to 3 grams per meter, and said granular explosive, at least in a zone nearest said donor cord, is superfine explosive.

25. The detonating cord assembly of claim 24 wherein said trunkline is the donor detonating cord, and the explosive immediately adjacent to the closed end of said first shell is superfine PETN.

26. The detonating cord assembly of claim 24 wherein said downline is the donor detonating cord, and the explosive in the spacing between the side walls of said shells is superfine PETN.

27. The detonating cord assembly of claim 11 wherein said trunkline or said downline is a donor detonating cord having a core explosive loading below about 1 gram per meter, and said granular explosive, in a zone nearest said donor cord, is lead azide.

28. The detonating cord assembly of claim 27 wherein said trunkline is the donor detonating cord, and said lead azide is adjacent to the closed end of said first shell.

29. The detonating cord assembly of claim 27 wherein said downline is the donor detonating cord, and said lead azide is in the spacing between the side walls of said shells.

30. The detonating cord assembly of claim 23 wherein said trunkline or downline is a donor detonating cord having a core explosive loading of at least about 2 grams per meter, and said granular explosive is cap-grade PETN.

* * * * *